US012084306B2

(12) United States Patent
Numata

(10) Patent No.: US 12,084,306 B2
(45) Date of Patent: Sep. 10, 2024

(54) SHEET FEEDING APPARATUS AND IMAGE FORMING APPARATUS

(71) Applicant: CANON KABUSHIKI KAISHA, Tokyo (JP)

(72) Inventor: Yoshiya Numata, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 79 days.

(21) Appl. No.: 17/943,524

(22) Filed: Sep. 13, 2022

(65) Prior Publication Data

US 2023/0079066 A1 Mar. 16, 2023

(30) Foreign Application Priority Data

Sep. 15, 2021 (JP) ..... 2021-150219

(51) Int. Cl.
*B65H 3/48* (2006.01)
*B65H 3/08* (2006.01)
*B65H 7/16* (2006.01)

(52) U.S. Cl.
CPC ..... *B65H 7/16* (2013.01); *B65H 3/08* (2013.01); *B65H 2301/442* (2013.01); *B65H 2301/4461* (2013.01); *B65H 2301/5143* (2013.01); *B65H 2406/10* (2013.01); *B65H 2513/10* (2013.01); *B65H 2557/23* (2013.01); *B65H 2701/12* (2013.01); *B65H 2701/1311* (2013.01)

(58) Field of Classification Search
CPC ..... B65H 3/48; B65H 3/08; B65H 2513/10; B65H 7/16; B65H 2557/10; B65H 2557/23; B65H 2406/10; B65H 2406/12; B65H 2406/121; B65H 2406/1211; B65H 3/06; B65H 3/0684; B65H 3/0669
See application file for complete search history.

(56) References Cited

U.S. PATENT DOCUMENTS

2009/0140489 A1* 6/2009 Takeuchi ..... B65H 1/14 271/109

FOREIGN PATENT DOCUMENTS

| | | | |
|---|---|---|---|
| JP | 11193148 A | * | 7/1999 |
| JP | 2005096992 A | | 4/2005 |
| JP | 2006027843 A | * | 2/2006 |
| JP | 2016084232 A | | 5/2016 |

* cited by examiner

*Primary Examiner* — Luis A Gonzalez
(74) *Attorney, Agent, or Firm* — ROSSI, KIMMS & McDOWELL LLP

(57) ABSTRACT

A sheet feeding apparatus includes a sheet supporting unit, a sheet feed unit, an air separation unit configured to separate the uppermost sheet by blowing the air onto a side surface of the sheet bundle supported by the sheet supporting unit, a velocity detection unit configured to detect actual velocity of a sheet fed by the sheet feed unit, a drive load detection unit configured to detect an actual drive load for feeding the sheet by the sheet feed unit, and a controller configured to control the sheet feed unit and the air separation unit. In a case where the sheet is fed by the sheet feed unit, the controller is configured to control an operation of the air separation unit depending on the actual velocity of the sheet detected by the velocity detection unit and the actual drive load detected by the drive load detection unit.

14 Claims, 11 Drawing Sheets

SHEET FEEDING APPARATUS AND IMAGE FORMING APPARATUS

BACKGROUND OF THE INVENTION

Field of the Invention

This disclosure relates to a sheet feeding apparatus feeding a sheet, and an image forming apparatus.

Description of the Related Art

Hitherto, an image forming apparatus, such as a printer, a facsimile, and a copier, includes an apparatus which is configured to form an image on a sheet fed by a sheet feeding apparatus in an image forming unit. In such an image forming apparatus, the sheet is fed by separating a sheet bundle set in the sheet feeding apparatus into one sheet at a time.

However, for example, coated paper coated with a coating layer on a sheet surface has a high smoothness, and, particularly, under a high humidity environment, absorbs moisture, so that sheets easily adhere and stick to each other. Therefore, in a case where the coated paper is set in the sheet feeding apparatus, there is the fear of the occurrence of no-feed (misfeed), in which, since it is not possible to separate the sheet from the sheet bundle, it is not possible to feed the sheet, and multi feed, in which a plurality of sheets are fed while sticking to each other.

So as to facilitate separation of the sheet, such as the coated paper, which easily sticks to each other, a method of separating the sheet by air is suggested (refer to Japanese Patent Laid-Open Nos. 2005-96992 and 2016-84232). In a case where the sheet is separated by blowing the air onto a side surface of the sheet bundle, Japanese Patent Laid-Open No. 2005-96992 suggests setting wind velocity depending on a material of the sheet and environment beforehand. Further, also in the case where the sheet is separated by blowing the air onto the side surface of the sheet bundle, Japanese Patent Laid-Open No. 2016-84232 suggests changing an air blow amount and controlling the air blow amount at an optimum amount at which a number of times of conveyance with the occurrence of fluttering of the sheet become the most.

Incidentally, the coating layer coated on a surface of the coated paper has properties of being brittle and easily scratched. Therefore, if the shear force received by the surface of the coated paper is large, the coating layer is peeled off. A part where the coating layer is peeled off generates a roller trace at the time of image formation, and degrades the quality of deliverables. Additionally, since the coating layer, which has been peeled off, adheres to a feeding roller and decreases a friction coefficient between the feeding roller and the sheet, further defective feeding is caused. Therefore, in a case where the feeding roller feeds the coated paper, it is necessary to decrease the conveyance resistance at the time of feeding.

However, since there are many different kinds of the coated paper, it is difficult and hardly practical to provide the optimum setting for the air blow amount depending on the material of the sheet beforehand as described in Japanese Patent Laid-Open No. 2005-96992. Further, in a case where, as suggested in Japanese Patent Laid-Open No. 2016-84232, the air blow amount is set at the amount at which the number of times of the conveyance with the occurrence of fluttering of the sheet become the most, there is the fear that, particularly, an air blow becomes too strong. If the air blow becomes strong as described above, the posture of the sheet is disturbed, and the positional accuracy at the time of the image formation is degraded. Therefore, regardless of effects of the kind of the sheet, the environment, and the like, it is desirable to prevent the defective feeding of the sheet by putting the air blow amount in an appropriate state where the air blow amount is required minimum.

SUMMARY OF THE INVENTION

According to a first aspect of present invention, a sheet feeding apparatus includes a sheet supporting unit configured to support a sheet bundle, a sheet feed unit configured to come into contact with an uppermost sheet of the sheet bundle supported by the sheet supporting unit and feed the uppermost sheet, an air separation unit including a fan configured to blow air, the air separation unit being configured to separate the uppermost sheet by blowing the air onto a side surface of the sheet bundle supported by the sheet supporting unit, a velocity detection unit configured to detect actual velocity of a sheet fed by the sheet feed unit, a drive load detection unit configured to detect an actual drive load for feeding the sheet by the sheet feed unit, and a controller configured to control the sheet feed unit and the air separation unit. In a case where the sheet is fed by the sheet feed unit, the controller is configured to control an operation of the air separation unit depending on the actual velocity of the sheet detected by the velocity detection unit and the actual drive load detected by the drive load detection unit.

According to a second aspect of present invention, a sheet feeding apparatus includes a sheet supporting unit configured to support a sheet bundle, a sheet feed unit configured to come into contact with an uppermost sheet of the sheet bundle supported by the sheet supporting unit and feed the uppermost sheet, an air separation unit including a fan configured to blow air, the air separation unit being configured to separate the uppermost sheet by blowing the air onto a side surface of the sheet bundle supported by the sheet supporting unit, a velocity detection unit configured to detect actual velocity of a sheet fed by the sheet feed unit, a drive load detection unit configured to detect an actual drive load for feeding the sheet by the sheet feed unit, and a controller configured to control the sheet feeding unit. In a case where the sheet is fed by the sheet feed unit, the controller is configured to control timing to start feeding a next sheet by the sheet feed unit depending on the actual velocity of the sheet detected by the velocity detection unit and the actual drive load detected by the drive load detection unit.

Further features of the present invention will become apparent from the following description of exemplary embodiments with reference to the attached drawings.

DESCRIPTION OF THE EMBODIMENTS

First Embodiment

Figure 1:
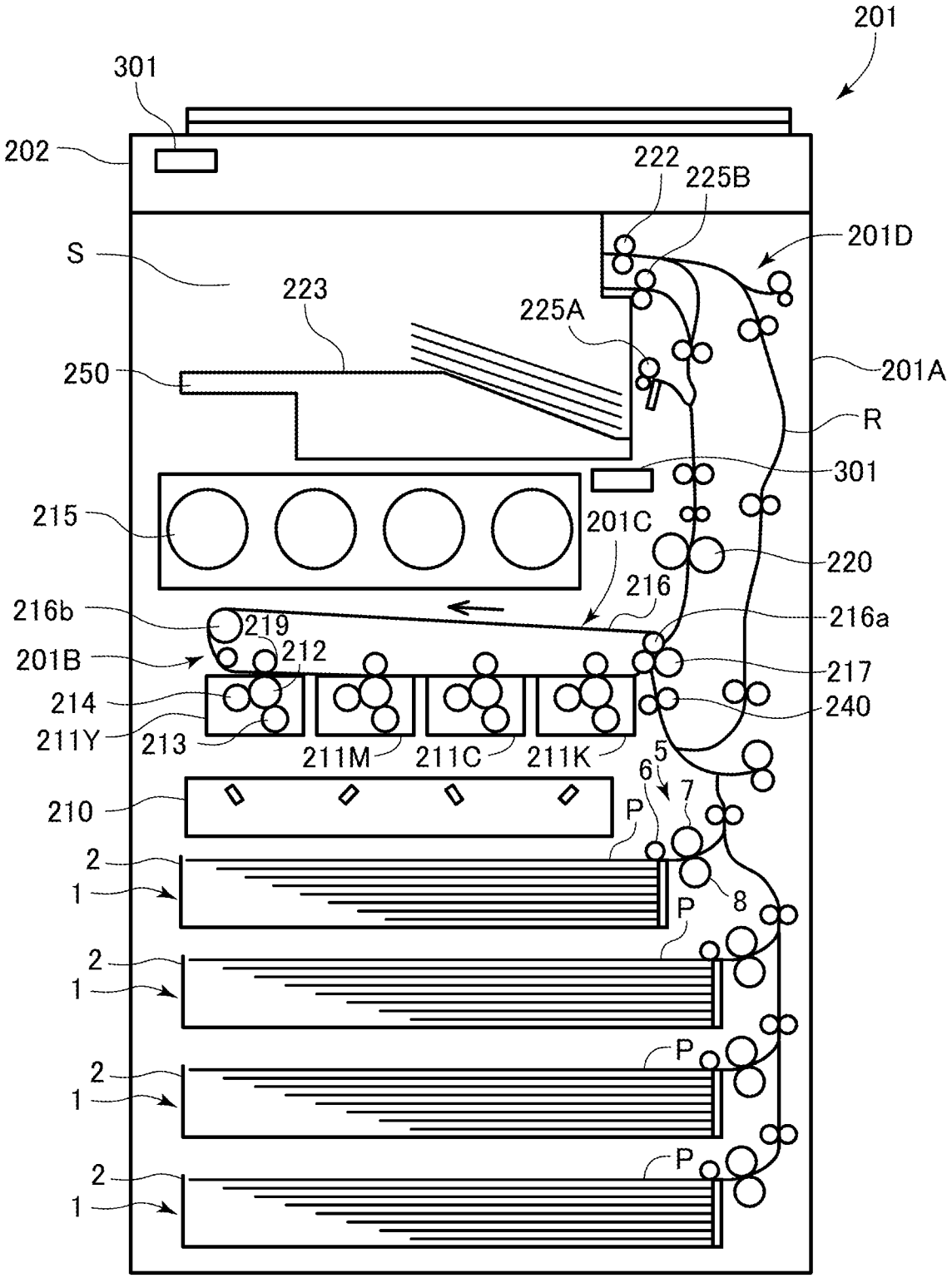
FIG. 1 is a schematic cross-sectional view showing an image forming apparatus relating to a first embodiment.

Hereinafter, a first embodiment relating to this disclosure will be described in detail with reference to drawings. First, an image forming apparatus in which a sheet feeding apparatus of this disclosure is disposed will be described using FIG. 1. FIG. 1 is a diagram showing a schematic configuration of the image forming apparatus relating to the first embodiment.

Schematic Configuration of Image Forming Apparatus

In FIG. 1, 201 is the image forming apparatus, 201A is an image forming apparatus body, and 201B is an image forming unit forming an image on a sheet. 202 is an image reading apparatus disposed approximately horizontally over the image forming apparatus body 201A, and a discharge space S for discharging the sheet is formed between the image reading apparatus 202 and the image forming apparatus body 201A.

The image forming unit 201B, serving as an image forming unit, is employing a four drum full color system. The image forming unit 201B includes a laser scanner 210 and four process cartridges 211Y, 211M, 211C, and 211K respectively forming four colors of toner images of yellow (Y), magenta (M), cyan (C), and black (K). Here, each of the process cartridges 211 includes a photosensitive drum 212, a charge device 213, serving as a charge unit, and a developing device 214, serving as a developing unit. Further, the image forming unit 201B includes an intermediate transfer unit 201C disposed over the process cartridge 211 and a fixing unit 220. To be noted, 215 is a toner cartridge for supplying a toner to the developing device 214.

The intermediate transfer unit 201C includes an intermediate transfer belt 216 wound around a drive roller 216*a* and a tension roller 216*b*. To be noted, a primary transfer roller 219 coming into contact with the intermediate transfer belt 216 at a position facing the photosensitive drum 212 is disposed inside of the intermediate transfer belt 216. Here, the intermediate transfer belt 216 is rotatably driven in an arrow direction by the drive roller 216*a* driven by a driving unit, not shown.

Then, the toner images of respective colors having a negative polarity on the photosensitive drum 212 are multiply transferred to the intermediate transfer belt 216 in sequence. A secondary transfer roller 217 transferring the color image formed on the intermediate transfer belt is disposed in a position facing the drive roller 216*a* of the intermediate transfer unit 201C. Further, the fixing unit 220 is disposed above this secondary transfer roller 217, and a first sheet discharge roller pair 225*a*, a second sheet discharge roller pair 225*b*, and a duplex reverse unit 201D are disposed on the upper left of this fixing unit 220. In this duplex reverse unit 201D, a reverse roller pair 222 capable of rotating in the normal and reverse directions, a reconveyance path R for conveying the sheet, on whose one surface the image has been formed, to the image forming unit 201B again, and the like are disposed.

Under the image forming apparatus body 201A, a sheet feed unit 1, serving as a sheet feeding apparatus sending the set sheet to the image forming unit, is disposed. The sheet feed unit 1 includes a feeding cassette 2 for storing the sheet and a pickup roller 6, serving as a feeding roller feeding the sheet stored in the feeding cassette 2. Further, the sheet feed unit 1 includes a separation unit including a feed roller 7 and a retard roller 8 for separating the sheet P sent out from the pickup roller 6.

Next, an image forming operation of the image forming apparatus 201 will be described. First, when the image reading apparatus 202 reads image information of a manuscript, after image processing has been performed, this image information is converted to an electric signal, and transmitted to the laser scanner 210 of the image forming unit 201B. In the image forming unit 201B, surfaces of the photosensitive drums 212, which are uniformly charged with a predetermined polarity and voltage by the charge devices 213, are exposed by a laser beam sequentially. Thereby, electrostatic latent images of yellow, magenta, cyan, and black are respectively formed on the photosensitive drums 212 of the respective process cartridges 211 sequentially.

Thereafter, this electrostatic latent image is developed by the toner of each color and visualized, and, by a primary transfer bias applied to the primary transfer roller 219*a*, toner images of the respective colors formed on the photosensitive drums are transferred to the intermediate transfer belt 216 in a manner of superimposing sequentially. Thus, the toner image is formed on the intermediate transfer belt 216.

On the other hand, the sheet P fed by the feed roller 7 of the sheet feed unit 1 is conveyed to a registration roller pair 240 including a drive and driven roller. At this time, driving of the registration roller pair 240 is being stopped, and a leading edge of the sheet P is abutted onto the registration roller pair 240. Thereby, the leading edge of the sheet P is brought to follow the registration roller pair 240. Thereafter, by continuing the conveyance of the sheet P by the feed roller 7, bending (loop) is formed in the sheet P, and, when a loop amount has become a predetermined amount, the registration roller pair 240 is driven. Thereby, the skew of the sheet P is corrected by the registration roller pair 240, and the sheet P whose skew has been corrected is conveyed to a secondary transfer unit by the registration roller pair 240. Then, in the secondary transfer unit, the toner image is collectively transferred onto the sheet P by a secondary transfer bias applied to a secondary transfer roller 217. Thereafter, the sheet P onto which the toner image has been transferred is conveyed to the fixing unit 220, and by receiving heat and pressure in the fixing unit 220, the toners of the respective colors are melted and mixed so as to be fixed on the sheet P as a color image.

Thereafter, the sheet P on which the image has been fixed is discharged to the discharge space S by the first and second sheet discharge roller pairs 225*a* and 225*b* disposed downstream of the fixing unit 220, and stacked on a stacking portion 223 projecting from a bottom surface of the discharge space S. To be noted, so as to form the images on both surfaces of the sheet P, after the image has been fixed, the sheet P is conveyed to the reconveyance path R by the reverse roller pair 222, and conveyed to the image forming unit 201B again.

Configuration of Sheet Feeding Unit

Figure 2:
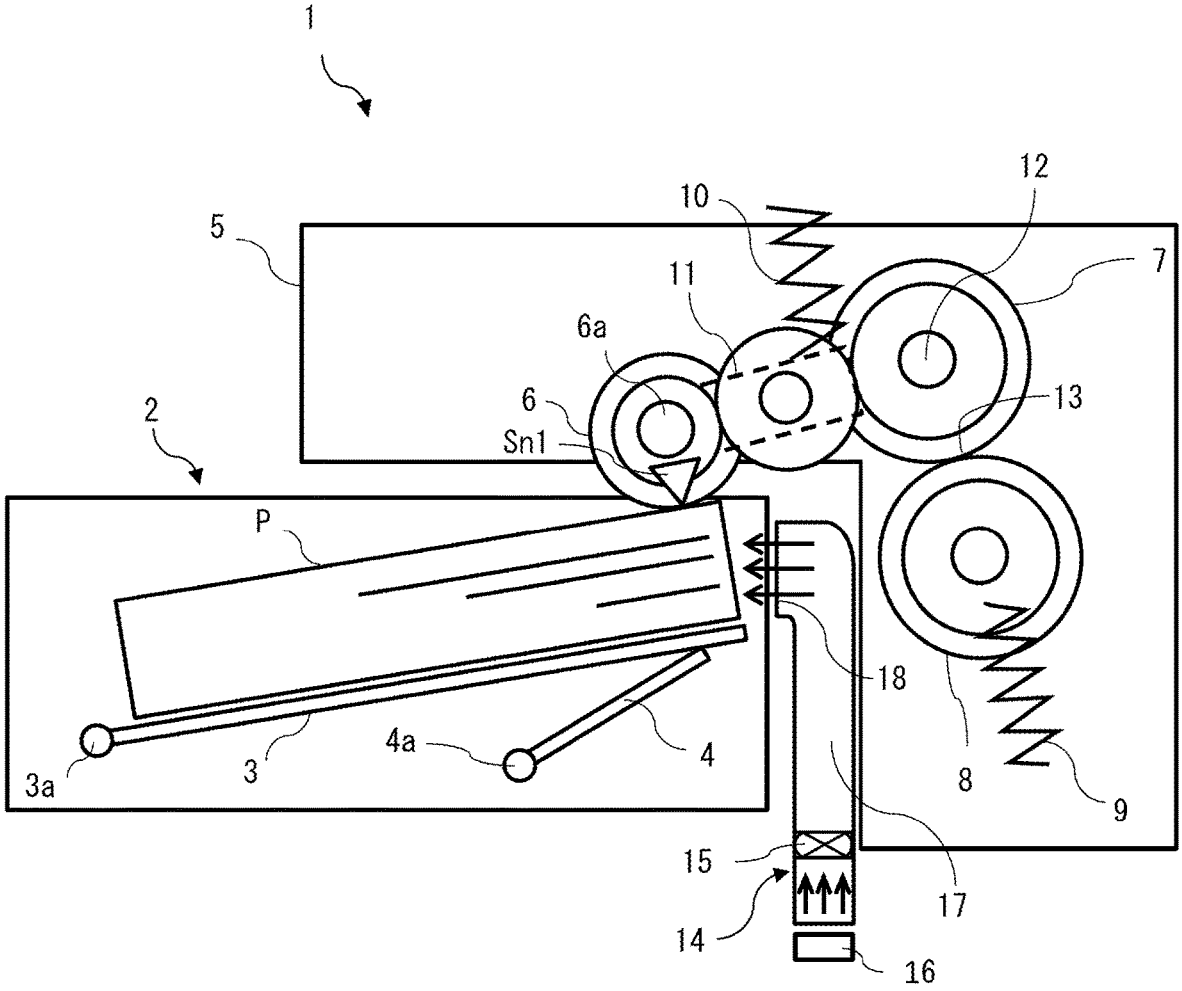
FIG. 2 is a schematic cross-sectional view showing a sheet feed unit relating to the first embodiment.

FIG. 2 is a schematic cross-sectional view showing the sheet feed unit 1 relating to this embodiment. The sheet feed unit 1 includes the feeding cassette 2, a sheet feeding unit 5, and an air blow unit 14, serving as an air separation unit. The feeding cassette 2 includes a sheet stacking tray 3, serving as a sheet supporting portion stacking the sheet P, and the sheet stacking tray 3 is pivotable around a pivot shaft 3*a* as a fulcrum. Further, under the sheet stacking tray 3, a lifting plate 4 pivotable by a drive shaft 4*a* is included, and lifts and lowers the sheet stacking tray 3 by the drive of a lifter motor M2 (refer to FIG. 3). By lifting the sheet stacking tray 3, an uppermost sheet of the sheet P in a sheet bundle stacked and supported on the sheet stacking tray 3 comes into contact with the pickup roller 6, described later, and becomes a state allowing feeding.

Figure 3:
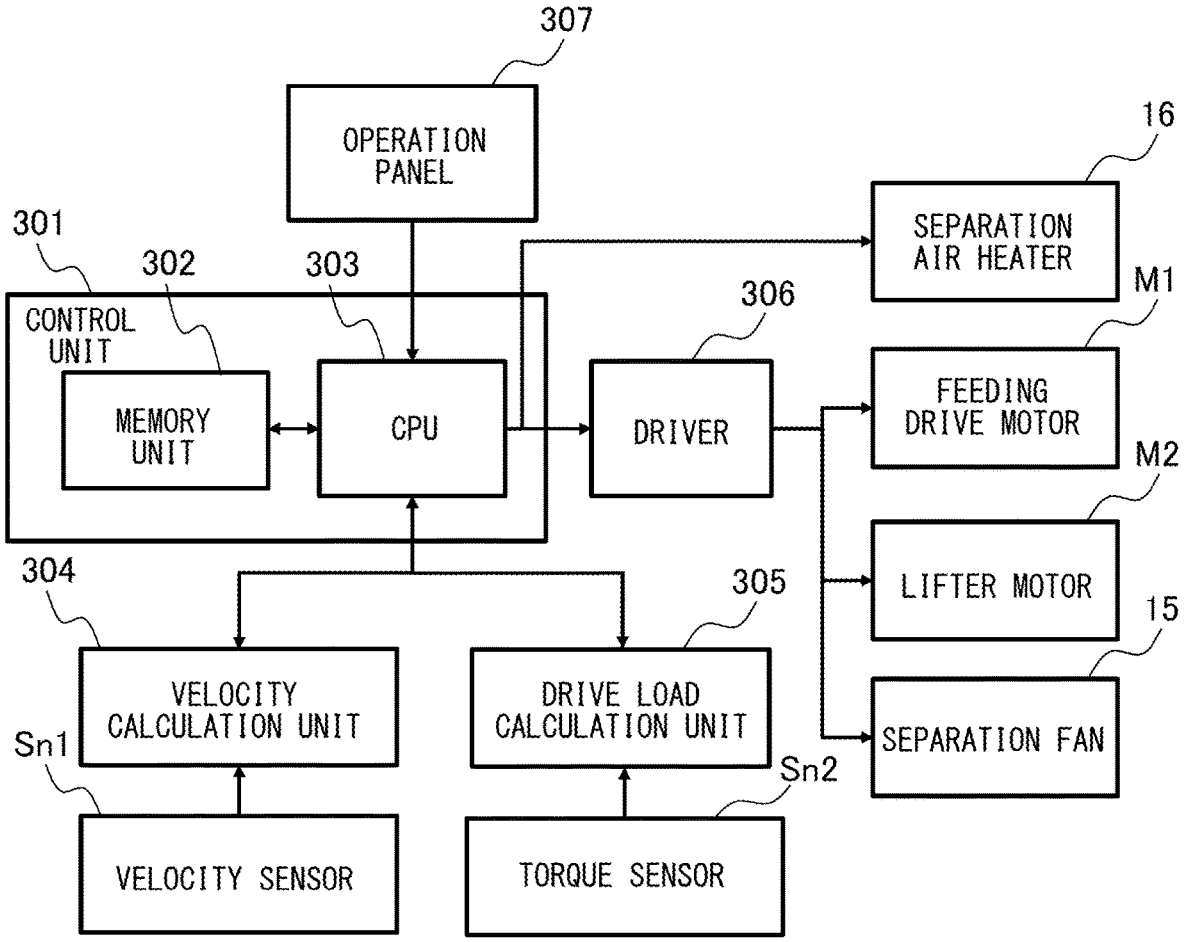
FIG. 3 is a control block diagram of the image forming apparatus relating to the first embodiment.

The sheet feeding unit 5 includes the pickup roller 6, the feed roller 7, and the retard roller 8, and these rollers are driven by a common feeding drive motor M1 (refer to FIG. 3). The pickup roller 6 is attached to a pickup roller shaft 6*a* extending from a lifting/lowering plate 11, and the lifting/lowering plate 11 is pivotable around a feeding drive shaft 12 as a center. Further, the lifting/lowering plate 11 is urged by a pickup spring 10 from above, and the pickup roller 6 presses the sheet P by this urging force.

The air blow unit 14 includes a separation air duct 17, a separation air nozzle 18, a separation fan 15, serving as a fan, and a separation air heater 16, serving as a heater. When a so-called air separation separating at least the uppermost sheet from the sheet stacked below by air is performed, by rotating the separation fan 15, the air is blown onto a side surface of the sheet bundle through the separation air duct 17 and the separation air nozzle 18. By bringing the blown air to enter between the sheets, the separation of the sheets from each other is facilitated. In addition, by heating the sending air by the separation air heater 16, the separation of the sheets from each other is further facilitated. To be noted, the air blow unit 14 of this embodiment performs an auxiliary role to assist in separating the sheets from each other performed by the feed roller 7 and the retard roller 8, described later.

For feeding the sheet P, in a state where the pickup roller 6 is brought into contact with the uppermost sheet among the sheets stacked on the sheet stacking tray 3 under a predetermined urging force, the feeding drive motor M1 is driven so as to rotatably drive the pickup roller 6. The sheet P sent out by the pickup roller 6 which comes into contact with the sheet P and is rotatably driven is fed to a separation nip portion 13, serving as a sheet separation portion, formed by the pressure contact of the feed roller 7 and the retard roller 8. By the action of a torque limiter (not shown), the sheet P is fed in a manner separated into one sheet at a time by the feed roller 7 and the retard roller 8. To be noted, instead of the feed roller 7 and the retard roller 8, it is acceptable to include, in the separation nip portion, a separation pad attached to the feeding cassette 2 and a roller such as the pickup roller 6 disposed in a manner capable of coming into contact with the separation pad.

A velocity sensor Sn1 and a velocity calculation unit 304 are included in the sheet feed unit 1, and included in a velocity detection unit detecting the velocity of the fed sheet. For example, an image sensor continuously photographing the sheet is used for the velocity sensor Sn1. Then, it is possible to detect the sheet velocity, at which the pickup roller 6 feeds the sheet, by processing a photographed image by the velocity calculation unit 304 and calculating the sheet velocity from a moving amount in a predetermined time. The information of the detected sheet velocity is sent to a controller 301.

Further, a torque sensor Sn2 and a drive load calculation unit 305 are included in the sheet feeding unit 1 (refer to FIG. 3), and included in a drive load detection unit detecting a drive load applied to the pickup roller 6 and the feeding drive motor M1 (refer to FIG. 3). This torque sensor Sn2 is disposed in a transmission mechanism, not shown, transmitting driving force from the feeding drive motor M1 (refer to FIG. 3) to the pickup roller 6, and is capable of detecting the drive load generated in the transmission mechanism. The information of the detected drive load is sent to the controller 301. To be noted, it is also possible to detect this drive load by detecting a change in an electrical current of the feeding drive motor M1 generated depending on the drive load, and by calculating the drive load from the change in the electrical current.

Configuration of Control System of Image Forming Apparatus

FIG. 3 is a control block diagram of the image forming apparatus 201 relating to this first embodiment. The controller 301 includes a central processing unit (CPU) 303, serving as a calculation unit, a memory unit 302 including a random-access memory (RAM), a read-only memory (ROM), and the like holding sequences, settings, and the like required for control. The controller 301 controls a display of an operation panel 307, serving as an operating unit, and determines the kind of the sheet depending on the information input in the operation panel 307. Further, the controller 301 receives the information of the velocity of the sheet calculated by the velocity calculation unit 304 and the information of the drive load calculated by the drive load calculation unit 305, and performs various calculations. In addition, the controller 301 is coupled to the separation air heater 16, and, further, coupled to the feeding drive motor M1, the lifter motor M2, and the separation fan 15 via a driver 306. That is, based on various calculation results, the controller 301 controls drive states of the feeding drive motor M1, the lifter motor M2, and the separation fan 15, and an output state of the separation air heater 16. In particular, the controller 301 is capable of freely setting a driving speed of the feeding drive motor M1 at the time of driving the feeding drive motor M1, and sets the conveyance velocity of the sheet by controlling the driving speed.

Control of Air Blow Unit

Next, using FIGS. 4, 5, 6, 7, and 8, the output setting control of the air blow unit 14 at the time of feeding the sheet in this first embodiment, in particular, the output setting control of the separation fan 15 and the separation air heater 16 will be described.

Figure 4:
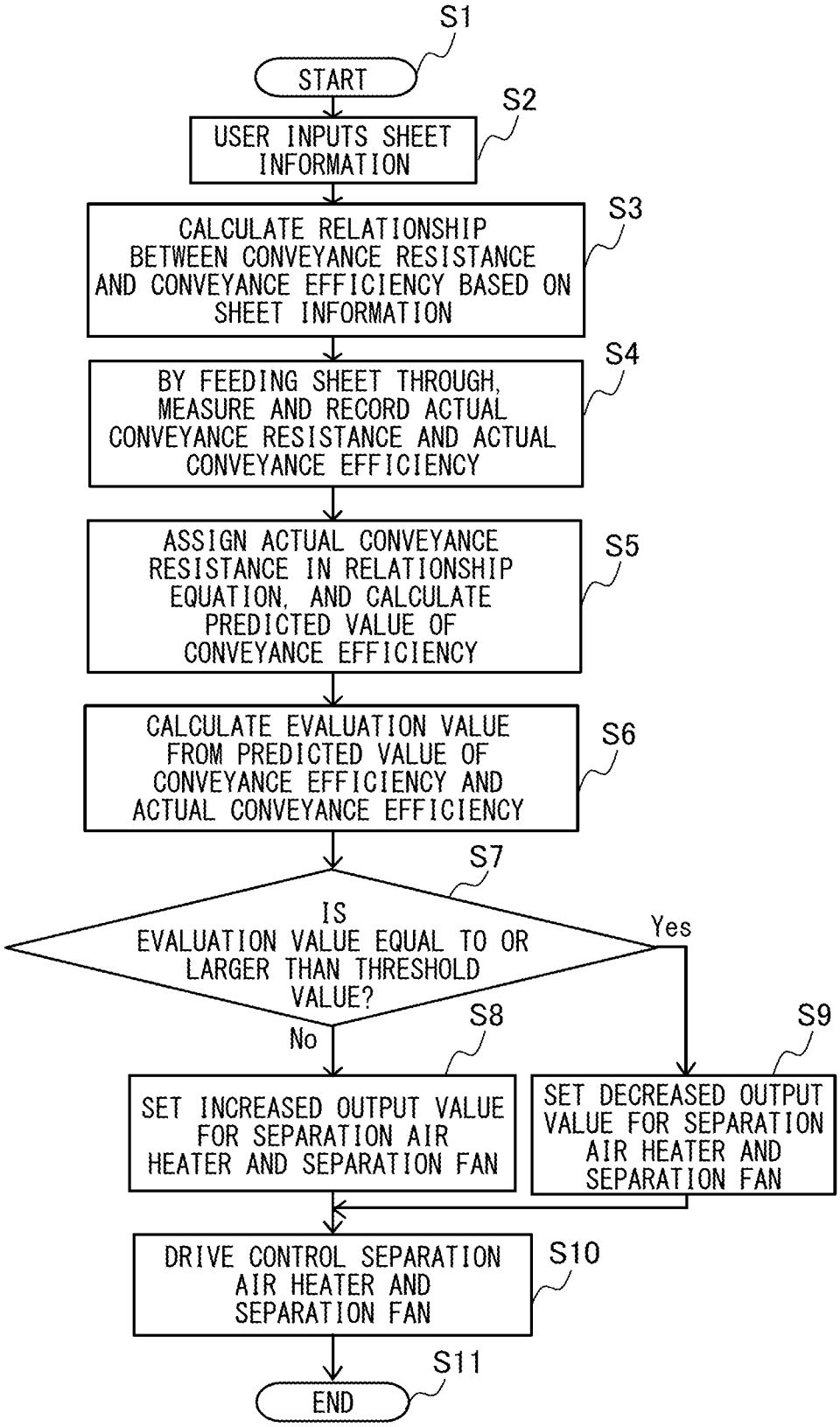
FIG. 4 is a flow chart showing output setting control of an air separation unit relating to the first embodiment.

As shown in FIG. 4, when the output setting control relating to this first embodiment is started (STEP: S1), at first, a user inputs sheet information in the operation panel 307, and, in particular, selects the kind of the sheet which is fed through the image forming apparatus 201 (STEP: S2). The sheet information input in the operation panel 307 basically exists in a database, stored in the memory unit 302, regarding the information of surface properties of a plurality of kinds of the sheet. Thereby, the controller 301 determines the kind of the sheet P to be fed from the sheet feed unit 1, and is possible to refer to the information of the surface properties of the sheet P. To be noted, it is also acceptable to determine the kind of the sheet by a media detection sensor, or by a signal from an external computer coupled to an interface, not shown.

Figure 5:
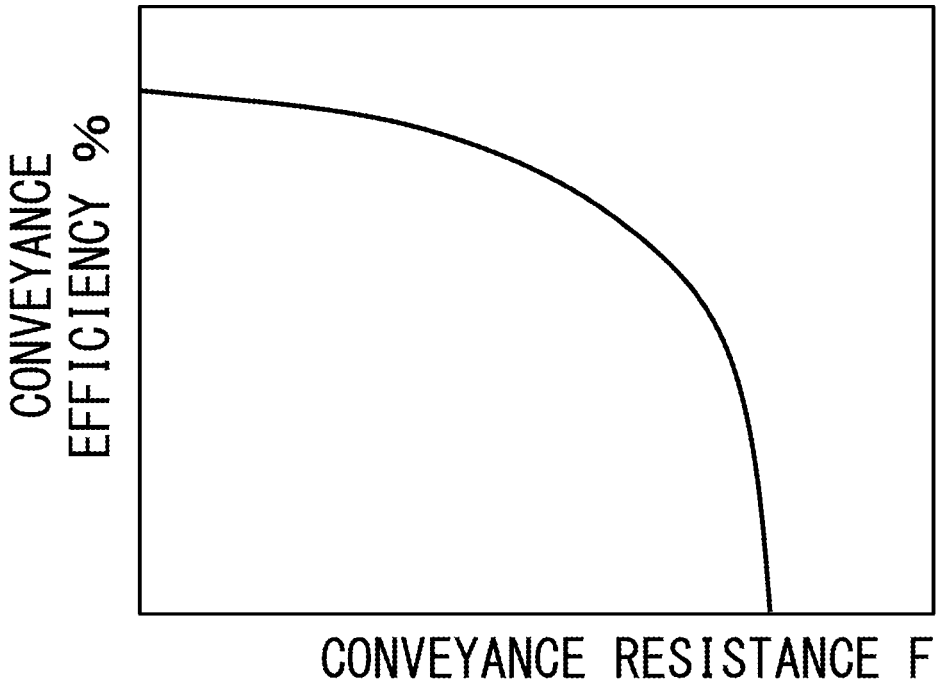
FIG. 5 is a diagram showing a relationship between conveyance resistance and conveyance efficiency.

Next, the controller 301 calculates a theoretical relationship equation between conveyance resistance F and conveyance efficiency as shown in FIG. 5 based on the kind of the sheet P which has been determined (STEP: S3). This conveyance resistance F is the force acting to prevent feeding at the time of feeding the sheet P. Further, the conveyance efficiency generally indicates a ratio of sheet velocity to a roller speed, and, in this description, is a ratio between the surface velocity of the pickup roller 6 and the feeding velocity of the sheet P.

Therefore, it is possible to express an equation of a curve shown in FIG. 5 by a tangent function.

$$Ec=1-A\tan(B\cdot F/P) \quad (1)$$

In this equation (1), Ec, F, and P are respectively the conveyance efficiency, the conveyance resistance, and roller contact pressure, and A and B are functions having variables of the roller contact pressure, the roller speed, and the surface properties of the sheet. Since the roller speed and the roller contact pressure are known, if the surface properties are known, it is possible to calculate the functions A and B. By referring to the database, the functions A and B are calculated from the information of the surface properties of the sheet based on the equation (1). At the time of calculating the functions A and B, a roughness parameters are used as characteristic values of the sheet surface properties. That is, the roughness parameters mentioned above are a roughness parameter R1 in a height direction of crests (or valleys) in a roughness curve of the sheet surface, and a roughness parameter R2 in a length direction of crests (or valleys) forming a contour curve.

Next, the user sets the sheet P in the feeding cassette 2, and feeds the sheet through the image forming apparatus 201. At this time, the actual sheet velocity of the sheet P is detected (measured) by the velocity sensor Sn1 and the velocity calculation unit 304 described above, and the drive load generated in the pickup roller 6 is detected (measured) by the torque sensor Sn2 and the drive load calculation unit 305. Since the detected drive load is almost generated by the conveyance resistance of the sheet P which is fed, it is possible to calculate the actual conveyance resistance of the sheet P (hereinafter referred to as actual conveyance resistance) (that is, an actual drive load) from the measured drive load. Further, by dividing the detected sheet velocity of the sheet P by the roller speed which is the surface velocity of the pickup roller 6, it is possible to calculate actual conveyance efficiency (hereinafter referred to as actual conveyance efficiency) (STEP S4).

Figure 6:
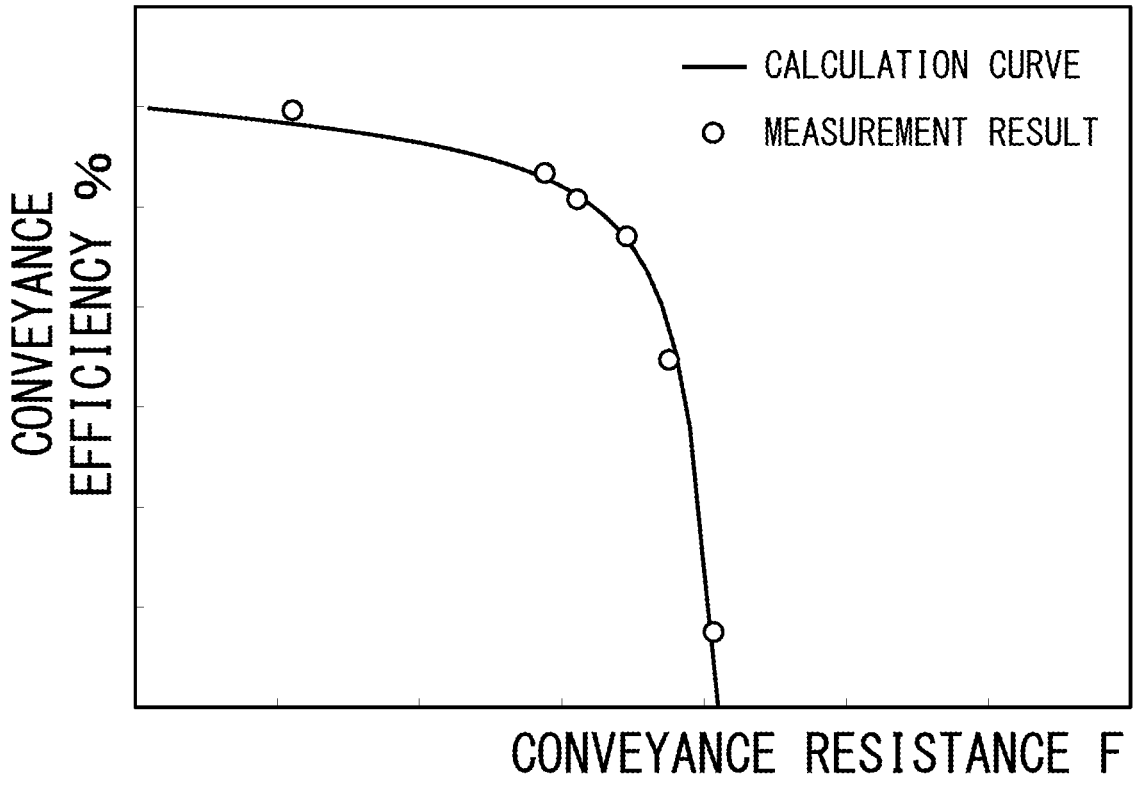
FIG. 6 is a diagram showing the relationship between the conveyance resistance and the conveyance efficiency, and measurement results of plain paper.

Here, FIG. 6 is a diagram showing in a manner superposing measurement results of the actual conveyance resistance and the actual conveyance efficiency measured in a case where, for example, the sheet is the plain paper, on a curve indicating a theoretical relationship between the conveyance resistance F, calculated from surface properties of the plain paper, the roller pressure, and the roller velocity, and the conveyance efficiency. As shown in FIG. 6, if, for example, the sheet is the plain paper, the measurement results result in close to the curve calculated by the equation (1).

Figure 7:
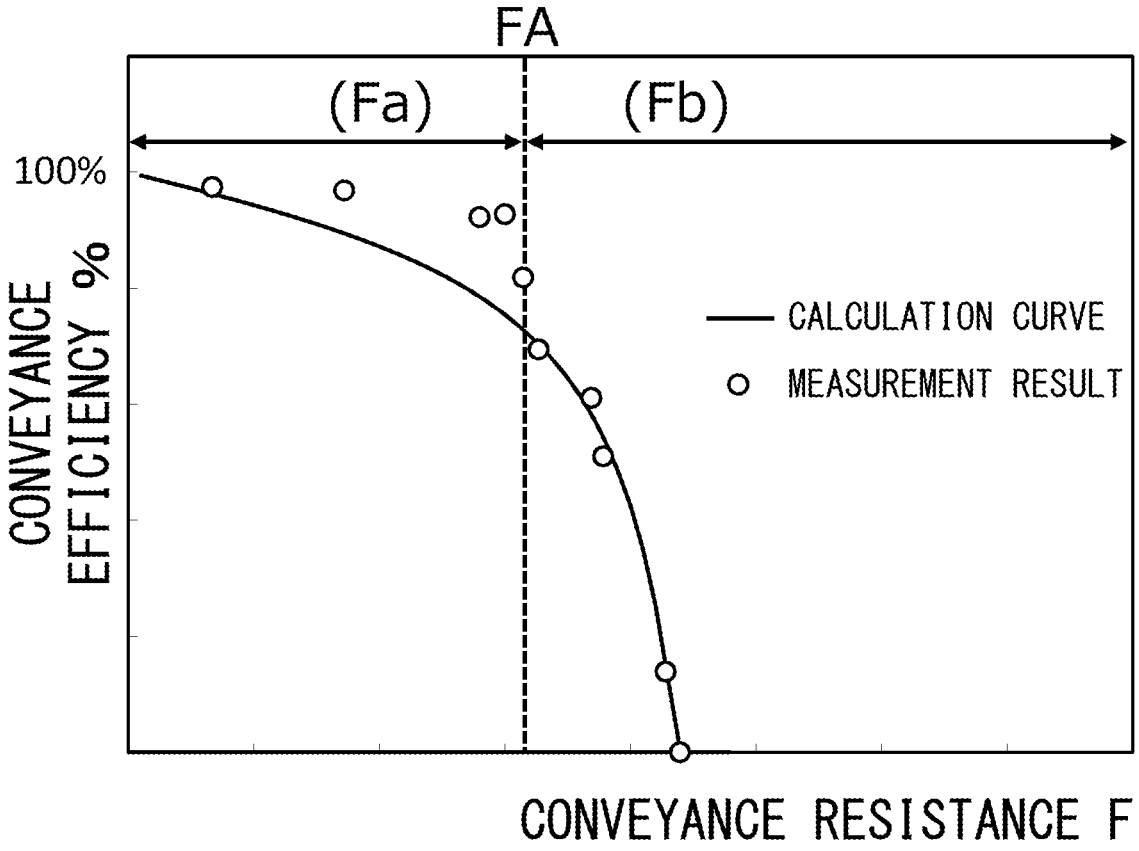
FIG. 7 is a diagram showing the relationship between the conveyance resistance and the conveyance efficiency, and measurement results of coated paper.

However, since the coating layer sticks (adheres) to the pickup roller 6 at the time of the feeding, the coated paper has characteristics different from the other sheets. FIG. 7 is a diagram showing in a manner superposing measurement results of the actual conveyance resistance and the actual conveyance efficiency measured in a case of the coated paper, on a curve indicating a theoretical relationship between the conveyance resistance F, calculated from surface properties of the coated paper, the roller pressure, and the roller velocity, and the conveyance efficiency.

That is, since the conveyance force at the time of feeding by a roller is increased by the adhesion force between the coating layer of the sheet P and the pickup roller 6, in an area Fa in FIG. 7, a decline in the conveyance efficiency is lessened in comparison with a case where the adhesion force is not present. On the other hand, in an area Fb where the conveyance resistance exceeds a value FA, the conveyance efficiency declines sharply, and becomes equal to the conveyance efficiency indicated by the curve calculated from the surface properties. The sharp decline in the conveyance efficiency occurs for a reason that a surface layer portion of the coating layer is peeled off by receiving the shear force generated in a nip portion of the pickup roller 6. Since the peeling of the coating layer contaminates the surface of the pickup roller 6 and causes the defective feeding as described above, so as to continuously convey the coated paper stably, it is necessary to feed the sheet P in the area Fa so that the peeling of the coating layer does not occur.

Therefore, an area where the peeling of the coating layer occurs is determined depending on the relationship equation between the conveyance resistance and the conveyance efficiency calculated at STEP S3 described above and the actual conveyance resistance and the actual conveyance efficiency detected at STEP S4 described above. First, by assigning the detected actual conveyance resistance in the equation (1) described above, a theoretical conveyance efficiency Ec (predicted value) is calculated (STEP S5). Then, based on the calculated conveyance efficiency Ec and the detected actual conveyance efficiency E, an evaluation value Pa is calculated by an equation below (STEP: S6).

$$Pa=(E-Ec)/F \quad (2)$$

Figure 8:
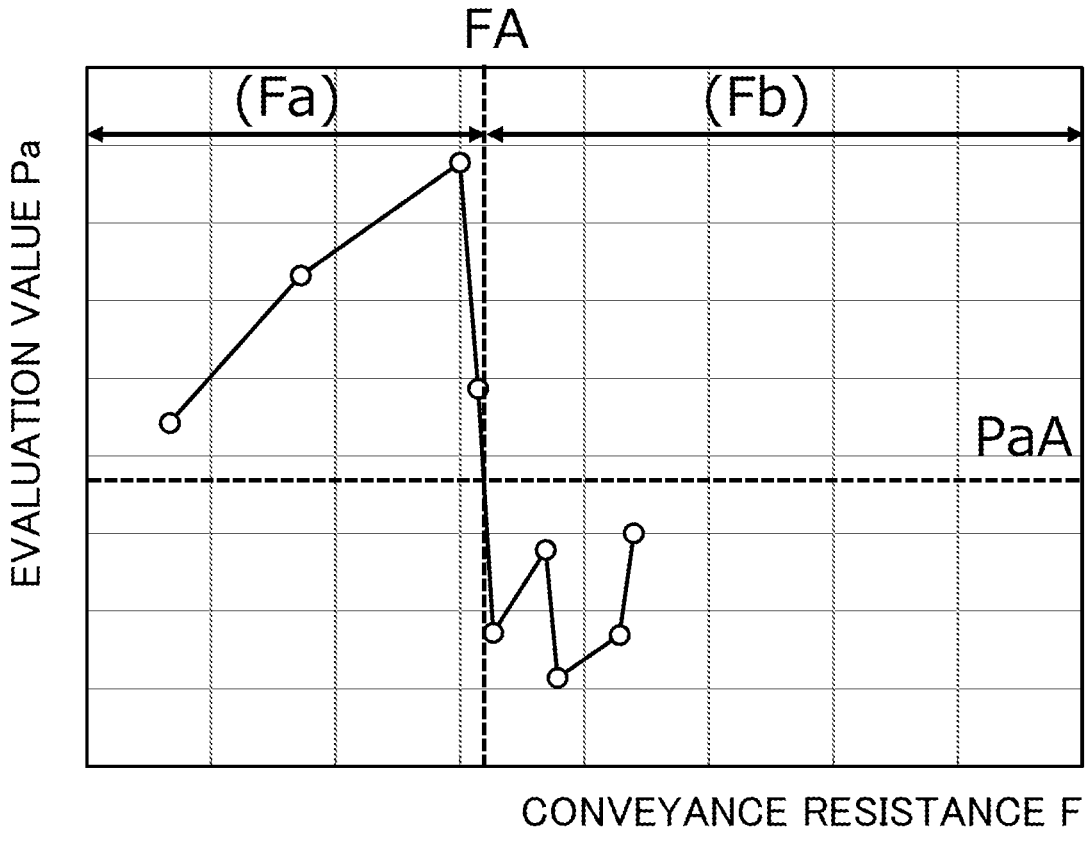
FIG. 8 is a diagram showing a relationship between the conveyance resistance and an evaluation value.

A result of the calculation of the evaluation value Pa by the equation (2) above is shown in FIG. 8. That is, the controller 301 judges whether or not this evaluation value Pa is equal to or larger than a threshold value PaA (STEP S7). That is, in the area Fa where the evaluation value Pa is equal to or larger than the threshold value PaA, such as the area Fa in FIG. 8, the controller 301 judges that the area is an area where the peeling of the coating layer does not occur (STEP S7: YES). On the other hand, in the area Fb where the evaluation value Pa is less than the threshold value PaA, the controller 301 judges that the area is an area where the peeling of the coating layer occurs (STEP S7: NO).

Since, as described above, whether or not the peeling of the coating layer does not occur has been determined for a state of feeding the sheet P, which is the coated paper, based on the judgement result, the output of the separation fan 15 and the separation air heater 16 is adjusted. That is, in a case where the evaluation value Pa is less than the threshold value PaA and is in the area Fb in FIG. 8 (STEP S7: NO), the controller 301 sets such that output values of the separation fan 15 and the separation air heater 16 are increased at the time of feeding the next sheet (STEP S8). Thereby, an air blow amount from the air blow unit 14 and an air temperature are drive controlled to increase (STEP S10). That is, by assisting in facilitating the separation of the uppermost sheet P from the sheet bundle, and, in other words, by facilitating the dehumidification of the uppermost sheet, the controller 301 performs control to increase the force separating the uppermost sheet P from the sheet stacked below, and ends this control (STEP S11). Therefore, at the time of feeding the next sheet P, the conveyance resistance F is controlled so as to decrease and become inside of the area Fa.

On the other hand, in a case where the evaluation value Pa is equal to or larger than the threshold value PaA and is in the area Fa in FIG. 8 (STEP S7: YES), the controller 301 judges that the peeling of the coating layer does not occur and the sheet P is fed stably. That is, the controller 301 sets the output values of the separation fan 15 and the separation air heater 16 such that the output values of the separation fan 15 and the separation air heater 16 are decreased within the range where this stable feeding is maintained (STEP S9). Thereby, the air blow amount from the air blow unit 14 and the air temperature are drive controlled to decrease (STEP S10). That is, the controller 301 relaxes the assistance in separating the sheet by the air blow unit 14, and, in other words, the controller 301 controls such that, by relaxing the dehumidification of the uppermost sheet, the force of separating the uppermost sheet P from the sheet stacked below is lessened, and ends this control (STEP S11). Therefore, at the time of feeding the next sheet P, the controller 301 performs control such that the conveyance resistance F is close to the value FA and the evaluation value Pa remains high.

As described above, by the sheet feed unit 1 relating to this first embodiment, an operation of the air blow unit 14 is controlled depending on the actual conveyance efficiency (actual conveyance velocity) of the sheet and the actual conveyance resistance (actual drive load) of the pickup roller 6 at the time of feeding the sheet. That is, for example, the controller 301 does not set the air blow amount depending on a sheet material, or does not control the air blow amount depending on a number of times of the conveyance with the occurrence of fluttering of the sheet, but performs feedback control depending on the actual conveyance efficiency and the actual conveyance resistance. Thereby, it is possible to put the air blow state by the separation fan 15 and the separation air heater 16 of the air blow unit 14 in an appropriate state and prevent the defective feeding of the sheet.

Further, by calculating the conveyance efficiency from the relationship of the equation (1) depending on the conveyance resistance and, on the other hand, detecting the actual conveyance efficiency, by calculating the evaluation value Pa from these values, and by judging whether or not the evaluation value Pa is equal to or larger that the threshold value PaA, it is possible to accurately determine the area where the peeling of the coating layer of the coated paper does not occur.

To be noted, the threshold value PaA described above is a value of the evaluation value when a value of the conveyance resistance is FA. Further, in this first embodiment, the threshold value PaA is updateable by calculation. In particular, in this first embodiment, at product shipment, regardless of kinds of the coated paper, a common default value is stored for the threshold value PaA. When the conveyance of a predetermined number of sheets of the coated paper has been performed using this default threshold value PaA, the controller 301 calculates the threshold value PaA using the actual conveyance resistance F and the conveyance efficiency E measured in the conveyance of the predetermined number of sheets of the coated paper.

That is, the controller 301 calculates a difference (E−EC) between the conveyance efficiency E of each measurement result and a theoretical value of the conveyance efficiency estimated at a value of the conveyance resistance of each measurement result based on a theoretical curve of the conveyance resistance and the conveyance efficiency calculated from the surface properties and the like of the coated paper. Next, the controller 301 identifies the measurement results in which the actual conveyance efficiency is equal to or less than a predetermined threshold value and the difference (E−Ec) described above is equal to or less than a predetermined threshold value. Then, a value between conveyance resistance of a measurement result, which is, among the measurement results not satisfying the above conditions, closest to a side of measurement results satisfying the above conditions, and conveyance resistance of a measurement result, which is, among the measurement results satisfying the above conditions, closest to a side of measurement results not satisfying the above conditions, is treated as the value FA of the conveyance resistance, which becomes a boundary for the kind of the coated paper measured at this time, and the evaluation value at this updated value FA is set to the threshold value PaA belonging to that kind of the coated paper.

As described above, since, in this first embodiment, the threshold value PaA of the evaluation value is calculated and set based on the actual measurement results, it is possible to set an appropriate threshold value PaA for each kind of the coated paper without storing a plurality of numbers of the threshold values PaA beforehand. Further, for example, by updating the threshold value PaA by each predetermined number of sheets using the method described above, it is possible to further improve the accuracy of the threshold value PaA.

To be noted, while, in the descriptions above, an example in which the conveyance of the coated paper for the first time is performed using the default threshold value PaA is described, for example, at the time of setting the threshold value PaA for the first time, and at the time of feeding the predetermined number of sheets of the coated paper for updating as described above, it is acceptable to convey the coated paper by controlling the air blow unit 14 such that there is a certain extent of variance in eventual values of the conveyance resistance.

To be noted, in this first embodiment, it is described that the area where the stable conveyance of the coated paper is possible is determined by calculating the evaluation value Pa. However, it is not limited to this, and it is possible to apply this type of a determination method to the determination of the other media (film, metallized paper, and the like) having properties of adhering to the feeding roller.

Second Embodiment

Next, a second embodiment in which the first embodiment described above is partly changed will be described using FIG. 9. This second embodiment is different, in comparison with the first embodiment described above, in a method of obtaining the information of the surface properties at STEP S2 described above. In this second embodiment, the surface properties do not refer to a database, but are measured by a surface property measurement device Sn3 included by being disposed alongside the image forming apparatus 201.

Figure 9:
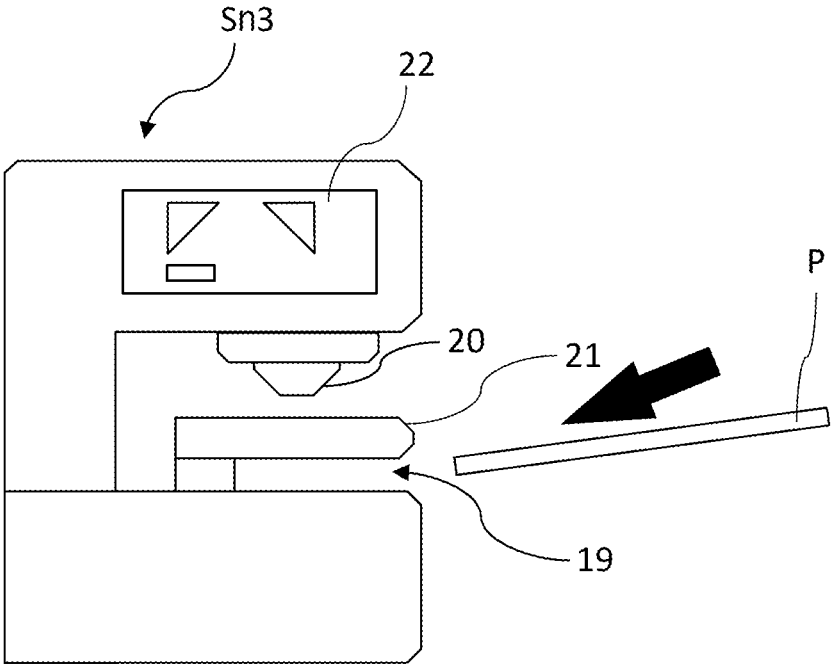
FIG. 9 is a schematic diagram showing a surface property measurement device relating to a second embodiment.

FIG. 9 is a schematic cross-sectional view of the surface property measurement device Sn3. The surface property measurement device Sn3 is a non-contact measurement device using a laser beam, and includes an optical unit 22 performing light emission and sensing, an objective lens 20, a sheet holder 21, and a sheet insertion slot 19. The optical unit 22 irradiates the laser beam, and receives reflected light from the sheet surface. A light receiving element included inside of the optical unit 22 senses a change in a light amount in arbitrary image forming positions, and records a position, where brightness is maximized in that position, as height information. The laser beam two-dimensionally scans a surface of an object, and, by synthesizing the height information of respective measurement positions inside of a scanning surface, it is possible to obtain the surface properties (three-dimensional information) of the sheet. Since the sheet P is held in a manner being pressed onto a seat surface by the sheet holder 21, the sheet P does not accidentally move during measurement.

The surface property measurement device Sn3 configured as described above measures the surface properties of the sheet P, and sends the information of the surface properties of the sheet P to the controller 301. The controller 301 obtains the information of the surface properties from the surface property measurement device Sn3, instead of user input, at STEP S2 in the output setting control in FIG. 4 described above, and performs control at STEP S3 and subsequent steps.

Thereby, even if the sheet P is a sheet whose surface property data corresponding to the kind of the sheet is not stored in the memory unit 302, it is possible to perform the output setting control in FIG. 4 depending on the information of the surface properties from the surface property measurement device Sn3. Therefore, it is possible to control operations of the separation fan 15 and the separation air heater 16 of the air blow unit 14 in an appropriate state.

To be noted, since any other configurations, functions, and effects are similar to the first embodiment, their descriptions will be omitted herein.

Third Embodiment

Figure 10:
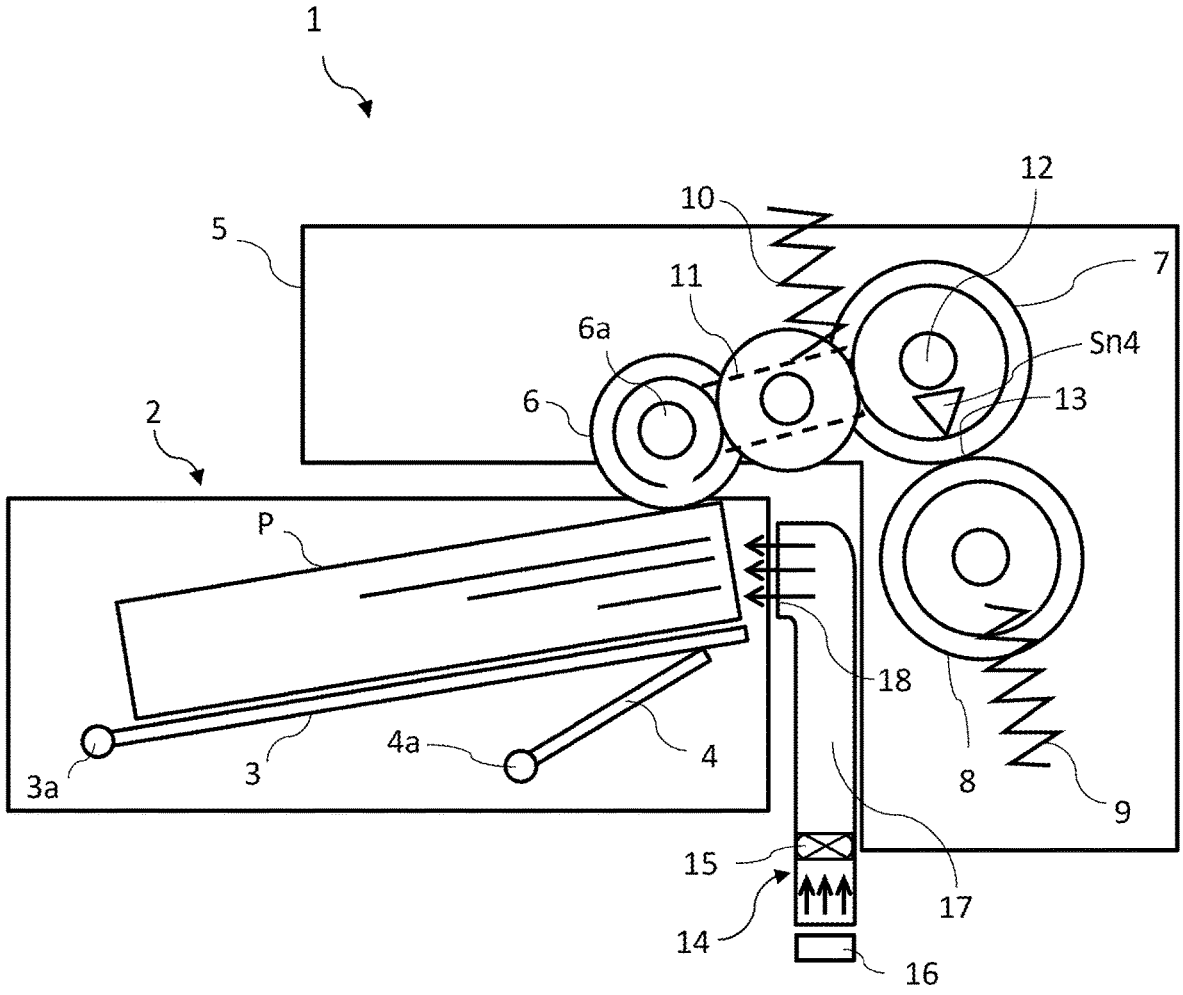
FIG. 10 is a schematic cross-sectional view showing a sheet feed unit relating to a third embodiment.
Figure 11:
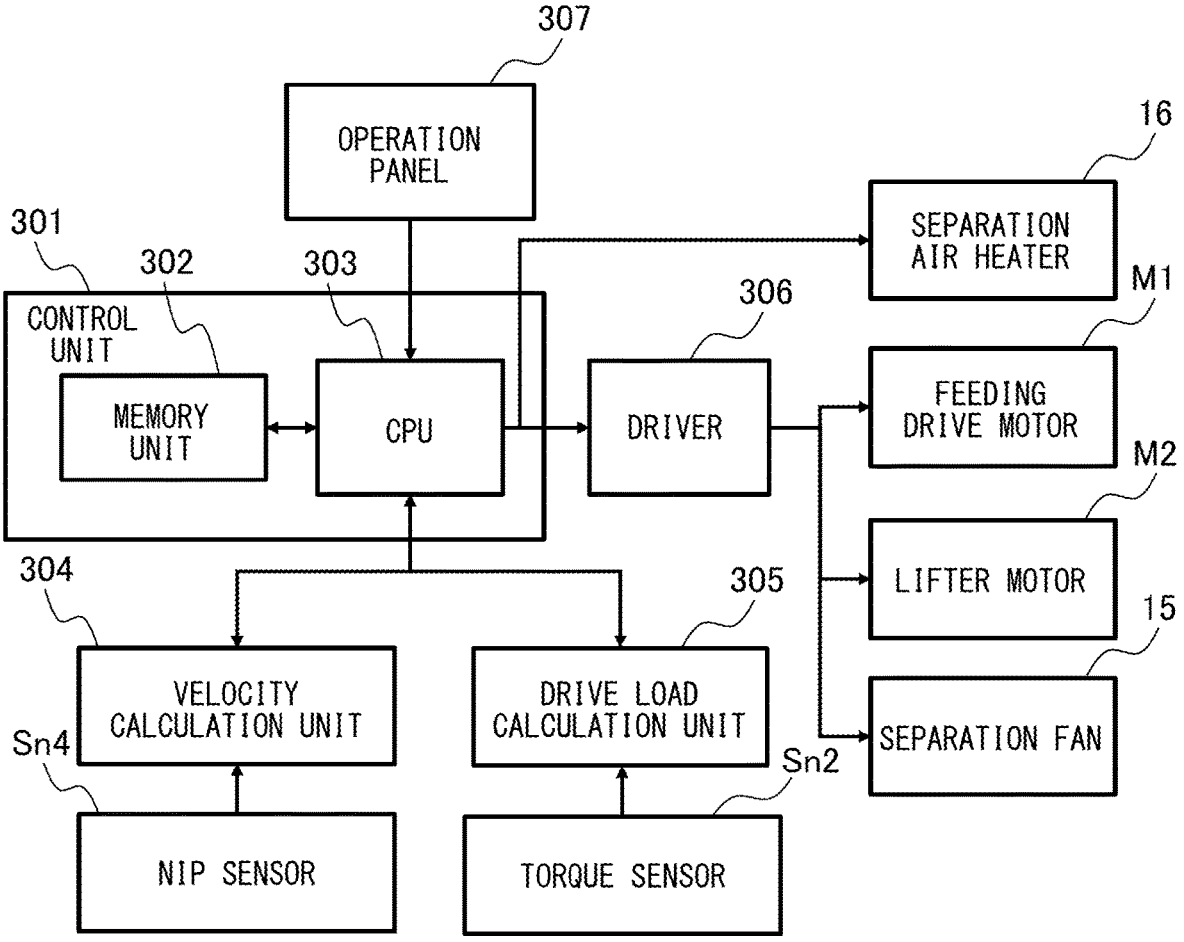
FIG. 11 is a control block diagram of an image forming apparatus relating to the third embodiment

Next, a third embodiment in which the first embodiment described above is partly changed will be described using FIGS. 10 and 11. In this third embodiment, in comparison with the first embodiment described above, a configuration for detecting the actual conveyance velocity of the sheet is changed. To be noted, FIG. 10 is a schematic cross-sectional diagram showing a sheet feed unit relating to the third embodiment, and FIG. 11 is a control block diagram of an image forming apparatus relating to the third embodiment.

In comparison with the first embodiment described above, the velocity sensor Sn1 is changed to a nip sensor Sn4, serving as a leading edge detection sensor. More specifically, in the sheet feed unit 1 of this third embodiment, the nip sensor Sn4 is disposed in parallel to the nip portion 13 formed by the feed roller 7 and the retard roller 8 disposed downstream of the pickup roller 6 in a sheet conveyance direction. The nip sensor Sn4 detects a leading edge of the sheet P by detecting a change in the nip pressure (change in a distance is also acceptable) of the nip portion 13 at the time of the passage of the leading edge of the sheet P which has been fed. That is, the nip sensor Sn4 detects the timing t1 in which the leading edge of the sheet P passes, and sends the signal to the velocity calculation unit 304.

On the other hand, at the time of feeding the sheet, the CPU 303 sends the timing t0 of a start of feeding the sheet P to the velocity calculation unit 304. A distance x1 from a waiting position of the sheet P in the sheet feeding unit 1 to a detection position of the nip sensor Sn4 is known. Therefore, the velocity calculation unit 304 calculates an average velocity v1 from a waiting position of the sheet P to the detection position of the nip sensor Sn4 based on an equation below.

$$v1 = x1/(t1 - t0) \quad (3)$$

It is possible to use the average velocity v1 of the sheet P calculated as described above as the actual conveyance velocity at STEP S4 in FIG. 4 described above.

To be noted, since any other configurations, functions, and effects in the third embodiment are similar to the first embodiment, their descriptions will be omitted herein.

Fourth Embodiment

Next, a fourth embodiment in which the first embodiment described above is partly changed will be described. In this fourth embodiment, based on the judgement result at STEP S4 in FIG. 4 described above, instead of controlling (changing) the output of the separation air heater 16 and the separation fan 15, the timing to start feeding the sheet P is changed.

More specifically, in a case where the evaluation value Pa is less than the threshold value PaA (refer to FIG. 8) at STEP S7 in FIG. 4 (STEP S7: NO), by setting an interval of the start time for feeding the sheet P to become longer, the controller 301 performs control (adjustment) such that the sheet P is fed at that timing. That is, the timing to start feeding the next sheet P is set such that an elapsed time after having started feeding the proceeding sheet P is lengthened (set the elapsed time at a second time which is longer than a first time). Thereby, since it is possible to blow the air, which has been dehumidified by the separation air heater 16, onto the uppermost sheet P for a long time, it is possible to decrease the conveyance resistance F.

On the other hand, in a case where the evaluation value Pa is equal to or larger than the threshold value PaA (refer to FIG. 8) at STEP S7 in FIG. 4 (STEP S7: YES), the controller 301 sets the interval of the start time for feeding the sheet P to become shorter within a range where the stable feeding is maintained. Then, the controller 301 perform control (adjustment) such that feeding of the sheet P is performed at that timing. That is, the timing to start feeding the next sheet P is set such that the elapsed time after having started feeding the proceeding sheet P is shortened (set the elapsed time at the first time). Thereby, the air blowing state by the separation fan 15 and the separation air heater 16 of the air blow unit 14 are brought to an appropriate state, and it is possible to prevent the defective feeding of the sheet.

Possibilities of Other Embodiments

To be noted, in the first to fourth embodiments described above, from the relationship between the conveyance efficiency and the drive load in accordance with the surface properties of the sheet, the conveyance efficiency is calculated depending on the actual drive load. Further, the actual conveyance efficiency is calculated depending on the actual velocity of the sheet in comparison with a set conveyance velocity. However, these are an example of the calculation, and, for example, a method such as calculating the evaluation value by preparing a table in which the actual velocity of the sheet and the evaluation value depending on the actual drive load are associated with each other is conceivable. Therefore, if it is possible to control the operation of the air blow unit while providing feedback based on the actual velocity of the sheet and the actual drive load, any calculation method is acceptable.

Further, in the first to fourth embodiments, the evaluation value is calculated by calculating the conveyance efficiency from the relationship between the conveyance efficiency and the drive load and, on the other hand, calculating the actual conveyance efficiency. However, it is acceptable to control the operation of the air blow unit, without calculating the evaluation value, using a difference between the calculated conveyance efficiency and the actual conveyance efficiency as condition.

Further, while, in the first to fourth embodiments, by calculating the evaluation value Pa, the operation (output) of the air blow unit is controlled depending on whether or not the evaluation value Pa is equal to or larger than the threshold value PaA, it is acceptable to set this evaluation value and threshold value at any value. Further, in particular, when the evaluation value Pa is calculated to be a negative value, the judgement regarding the threshold value PaA is reversed.

Further, in the first to fourth embodiments, in a case calculating the sheet velocity, it is described that the velocity calculation unit 304 calculates the actual velocity based on the signal of the velocity sensor Sn1 or the nip sensor Sn4. While the velocity calculation unit 304 is different from the controller 301 and a driver circuit and the like controlling these sensors are assumed, it is acceptable to eliminate the velocity calculation unit 304 by performing the calculation of the velocity calculation unit 304 in the controller 301.

Further, in the first to fourth embodiments, in a case calculating the drive load (conveyance resistance F), it is described that the drive load calculation unit 305 calculates the actual drive load based on the signal of the torque sensor Sn2. While the drive load calculation unit 305 is different from the controller 301 and a driver circuit and the like controlling the torque sensor are assumed, it is acceptable to eliminate the drive load calculation unit 305 by performing the calculation of the drive load calculation unit 305 in the controller 301.

Further, while, in the first to fourth embodiments, it is described that the image is formed by the image forming apparatus 201 employing an electrophotographic system, it is not limited to this, and any type of image forming system, such as an ink jet system, is acceptable.

Further, while, in the second embodiment, it is described that the surface property measurement device Sn3 is included in the image forming apparatus 201, if there is a connection relation capable of sending a signal to the controller 301, it is acceptable to dispose the device alongside as a unit different from the image forming apparatus.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-150219, filed Sep. 15, 2021, which is hereby incorporated by reference herein in its entirety.

What is claimed is:

1. A sheet feeding apparatus comprising:

a sheet supporting unit configured to support a sheet bundle;

a sheet feed unit configured to come into contact with an uppermost sheet of the sheet bundle supported by the sheet supporting unit and feed the uppermost sheet;

an air separation unit including a fan configured to blow air, the air separation unit being configured to separate the uppermost sheet by blowing the air onto a side surface of the sheet bundle supported by the sheet supporting unit;

a velocity detection unit configured to detect a velocity of a sheet fed by the sheet feed unit;

a drive load detection unit configured to detect a drive load for feeding the sheet by the sheet feed unit;

a memory unit storing information of surface properties of the sheet; and a controller configured to control the sheet feed unit and the air separation unit, wherein the controller is configured to:

refer a relationship equation between a conveyance efficiency and a conveyance resistance in accordance with the information of surface properties of the sheet stored in the memory unit;

control the sheet feed unit to feed the sheet in a set conveyance velocity;

detect the drive load for feeding the sheet fed in the set conveyance velocity by the drive load detection unit and the conveyance velocity of the sheet fed in the set conveyance velocity by the velocity detection unit;

calculate a theoretical conveyance efficiency based on the relationship equation and the detected drive load;

calculate a detected conveyance efficiency based on the detected conveyance velocity by the velocity detection unit; and control an operation of the air separation unit based on the theoretical conveyance efficiency and the detected conveyance efficiency.

2. The sheet feeding apparatus according to claim 1, wherein the controller is configured to:

calculate an evaluation value from the theoretical conveyance efficiency and the detected conveyance efficiency; and control the operation of the air separation unit to increase force for separating the uppermost sheet from the sheet stacked below, in a state where the calculated evaluation value does not meet a threshold value.

3. The sheet feeding apparatus according to claim 2, wherein the controller is configured to control the operation of the air separation unit to decrease the force for separating the uppermost sheet from the sheet stacked below, in a state where the evaluation value meets the threshold value.

4. The sheet feeding apparatus according to claim 2, wherein the controller is configured to increase the force for separating the uppermost sheet from the sheet stacked below by increasing output of the fan.

5. The sheet feeding apparatus according to claim 2, wherein;

the air separation unit includes a heater configured to heat the air blown by the fan, and the controller is configured to increase the force for separating the uppermost sheet from the sheet stacked below by increasing heating of the air with the heater.

6. The sheet feeding apparatus according to claim 1, wherein:

the memory unit stores information of surface properties of a plurality of kinds of sheets, the controller is configured to set the relationship equation based on the information of the surface properties of the plurality of kinds of sheets stored in the memory unit.

7. The sheet feeding apparatus according to claim 1, further comprising:

a surface property measurement unit configured to detect the surface properties of the sheet, and configured to output the information of the detected surface properties to the controller, wherein the controller is configured to refer the relationship equation in accordance with the information of the surface properties of the sheet output by the surface property measurement unit.

8. The sheet feeding apparatus according to claim 1, wherein the velocity detection unit includes a velocity sensor configured to detect a movement amount of the sheet, and configured to calculate the velocity of the sheet from the movement amount of the sheet in a predetermined time period.

9. The sheet feeding apparatus according to claim 1, wherein:

the sheet feed unit includes a feeding roller configured to come into contact with the uppermost sheet of the sheet bundle and configured to feed the uppermost sheet, the velocity detection unit includes a leading edge detection sensor disposed downstream of the feeding roller in a sheet conveyance direction and configured to detect a leading edge of the sheet, and the velocity detection unit is configured to calculate;

the velocity of the sheet based on a time period, from a start of feeding the sheet by the sheet feed unit to detection of the leading edge of the sheet by the leading edge detection sensor; and a distance between the sheet feed unit and the leading edge detection sensor.

10. The sheet feeding apparatus according to claim 1, further comprising:

a sheet separation unit disposed downstream of the sheet feed unit in a sheet conveyance direction and configured to separate the sheet into one sheet at a time in a state where multi feed of the uppermost sheet and the sheet stacked below occurs, wherein the air separation unit is configured to assist in separation of the uppermost sheet and the sheet stacked below.

11. A sheet feeding apparatus comprising:

a sheet supporting unit configured to support a sheet bundle;

a sheet feed unit configured to come into contact with an uppermost sheet of the sheet bundle supported by the sheet supporting unit and feed the uppermost sheet;

an air separation unit including a fan configured to blow air, the air separation unit being configured to separate the uppermost sheet by blowing the air onto a side surface of the sheet bundle supported by the sheet supporting unit;

a velocity detection unit configured to detect a velocity of a sheet fed by the sheet feed unit;

a drive load detection unit configured to detect a drive load for feeding the sheet by the sheet feed unit;

a memory unit storing information of surface properties of the sheet; and a controller configured to control the sheet feeding unit, wherein the controller is configured to control timing to start feeding a next sheet by the sheet feed unit based on the detected velocity of the sheet detected by the velocity detection unit and the detected drive load detected by the drive load detection unit.

12. The sheet feeding apparatus according to claim 11, wherein the controller is configured to:

refer a relationship equation between a conveyance efficiency and a conveyance resistance in accordance with the information of surface properties of the sheet stored in the memory unit;

control the sheet feed unit to feed the sheet in a set conveyance velocity;

detect the drive load for feeding the sheet fed in the set conveyance velocity by the drive load detection unit and the conveyance velocity of the sheet fed in the set conveyance velocity by the velocity detection unit;

calculate a theoretical conveyance efficiency based on the relationship equation and the detected drive load; and control the timing to start feeding the next sheet by the sheet feed unit based on the theoretical conveyance efficiency and the detected conveyance efficiency.

13. The sheet feeding apparatus according to claim 12, wherein the controller is configured to:

calculate an evaluation value from the theoretical conveyance efficiency and the detected conveyance efficiency; and control the timing to start feeding the next sheet by the sheet feed unit so that an elapsed time becomes, after having fed a proceeding sheet:

a first time, in a state where the evaluation value meets a threshold value; and a second time, which is longer than the first time, in a state where the evaluation value does not meet the threshold value.

14. An image forming apparatus comprising:

a sheet feeding apparatus comprising:

a sheet supporting unit configured to support a sheet bundle;

a sheet feed unit configured to come into contact with an uppermost sheet of the sheet bundle supported by the sheet supporting unit and feed the uppermost sheet;

an air separation unit including a fan configured to blow air, the air separation unit being configured to separate the uppermost sheet by blowing the air onto a side surface of the sheet bundle supported by the sheet supporting unit;

a velocity detection unit configured to detect a velocity of a sheet fed by the sheet feed unit;

a drive load detection unit configured to detect a drive load for feeding the sheet by the sheet feed unit;

a memory unit storing information of surface properties of the sheet; and a controller configured to control the sheet feed unit and the air separation unit, wherein the controller is configured to:

refer a relationship equation between a conveyance efficiency and a conveyance resistance in accordance with the information of surface properties of the sheet stored in the memory unit;

control the sheet feed unit to feed the sheet in a set conveyance velocity;

detect the drive load for feeding the sheet fed in the set conveyance velocity by the drive load detection unit and the conveyance velocity of the sheet fed in the set conveyance velocity by the velocity detection unit;

calculate a theoretical conveyance efficiency based on the relationship equation and the detected drive load;

calculate a detected conveyance efficiency based on the detected conveyance velocity by the velocity detection unit; and control an operation of the air separation unit based on the theoretical conveyance efficiency and the detected conveyance efficiency; and an image forming unit configured to form an image on the sheet fed from the sheet feeding apparatus.

* * * * *